US007891653B2

(12) United States Patent
Park et al.

(10) Patent No.: US 7,891,653 B2
(45) Date of Patent: Feb. 22, 2011

(54) BILL RECYCLING MACHINE

(75) Inventors: Chang Ho Park, Gyeonggi-do (KR); Jin Yong Hwang, Gyeonggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 437 days.

(21) Appl. No.: 11/962,837

(22) Filed: Dec. 21, 2007

(65) Prior Publication Data

US 2008/0156614 A1 Jul. 3, 2008

(30) Foreign Application Priority Data

Dec. 29, 2006 (KR) ..... 10-2006-0139032

(51) Int. Cl.
*B65H 83/00* (2006.01)

(52) U.S. Cl. ..... 271/3.14; 271/315

(58) Field of Classification Search ..... 271/3.14, 271/4.01, 4.08, 187, 315
See application file for complete search history.

(56) References Cited

U.S. PATENT DOCUMENTS 5,393,196 A * 2/1995 Bluemle ..... 414/790.2
7,299,978 B2 * 11/2007 Park et al. ..... 235/379

FOREIGN PATENT DOCUMENTS

| | | | |
|---|---|---|---|
| KR | 2005071234 | A | 7/2005 |
| KR | 2003093252 | A | 8/2005 |
| KR | 2005098446 | A | 10/2005 |
| KR | 2006129614 | A | 12/2006 |

* cited by examiner

*Primary Examiner*—Stefanos Karmis
*Assistant Examiner*—Michael C McCullough
(74) *Attorney, Agent, or Firm*—Fish & Richardson P.C.

(57) ABSTRACT

A bill recycle machine including a push plate exerting pressure on bills, which can apply separation pressure required for separating bills and also can be elevated upward and downward so as to prevent the push plate from being interfered with by a pickup roller when untaken bills is collected again. The bill recycle machine includes: a front plate forming a wall surface of a front side of a bill receiving space formed at a lower part of a shutter, a push plate which forms a first bill receiving space between the push plate and the front plate, a stack plate installed at an opposite side of the first bill receiving space, based on the push plate, so as to support bills stacked by a stack wheel; and a transfer plate forming a second bill receiving space between the transfer plate and the stack plate.

4 Claims, 10 Drawing Sheets

[Fig.1]
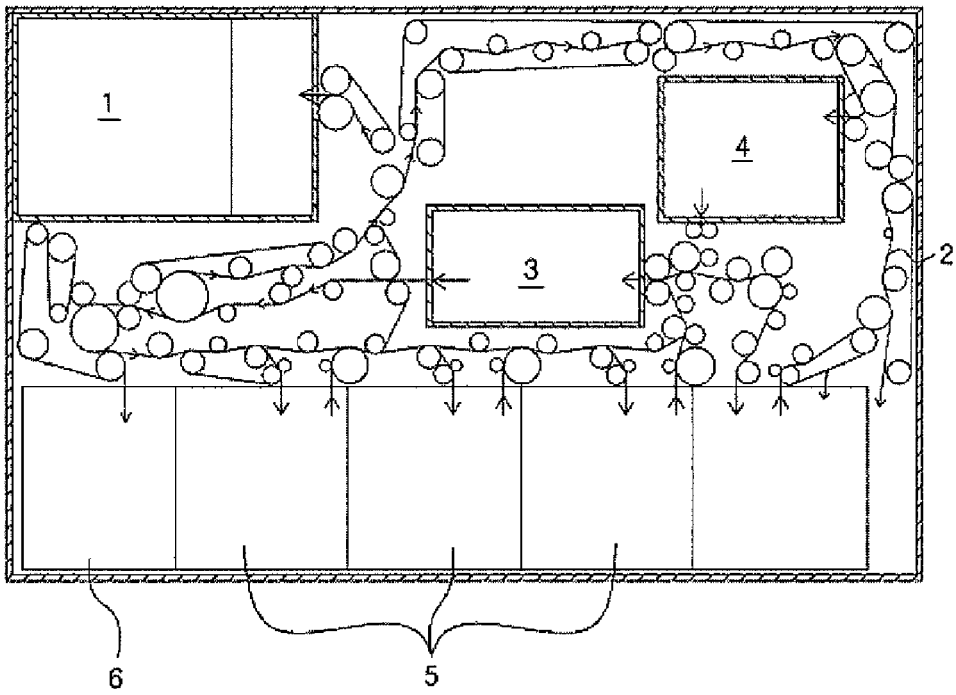
PRIOR ART

[Fig.2]
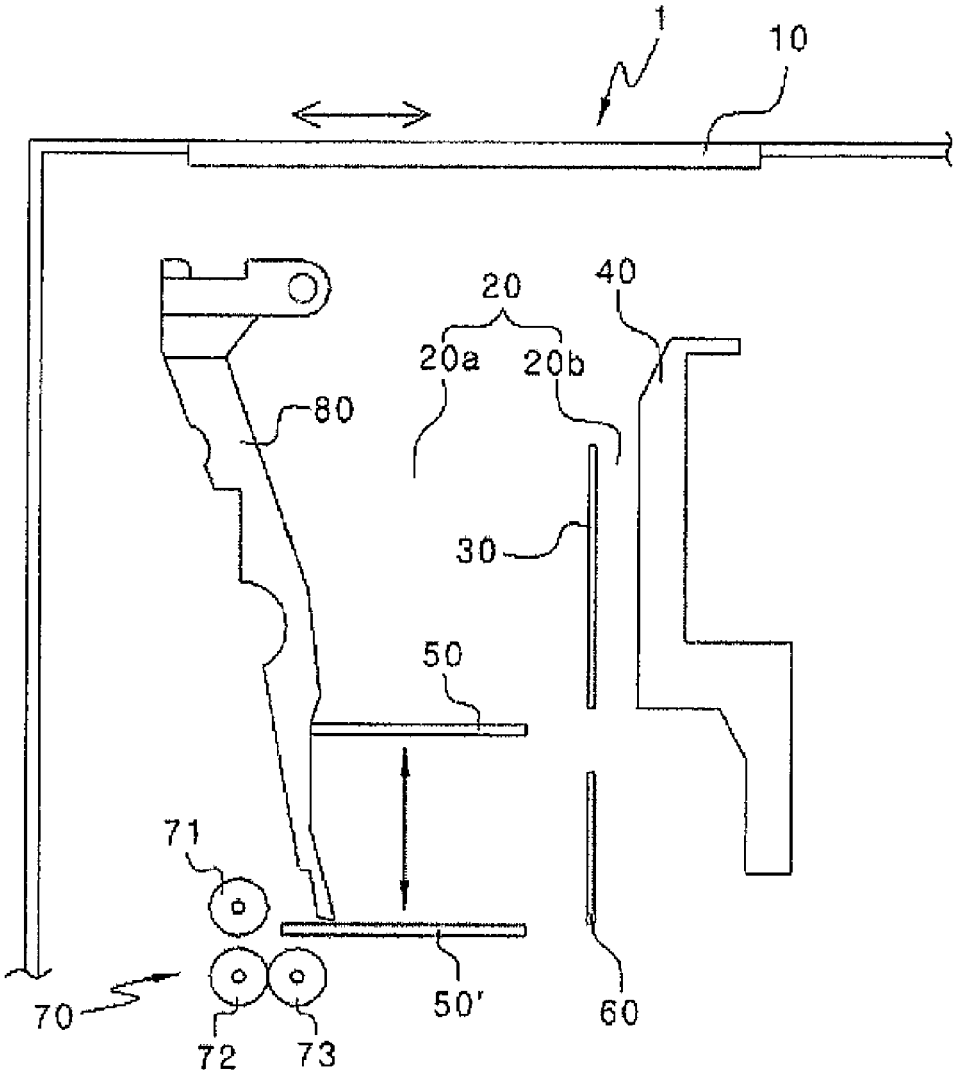
PRIOR ART

[Fig.3]
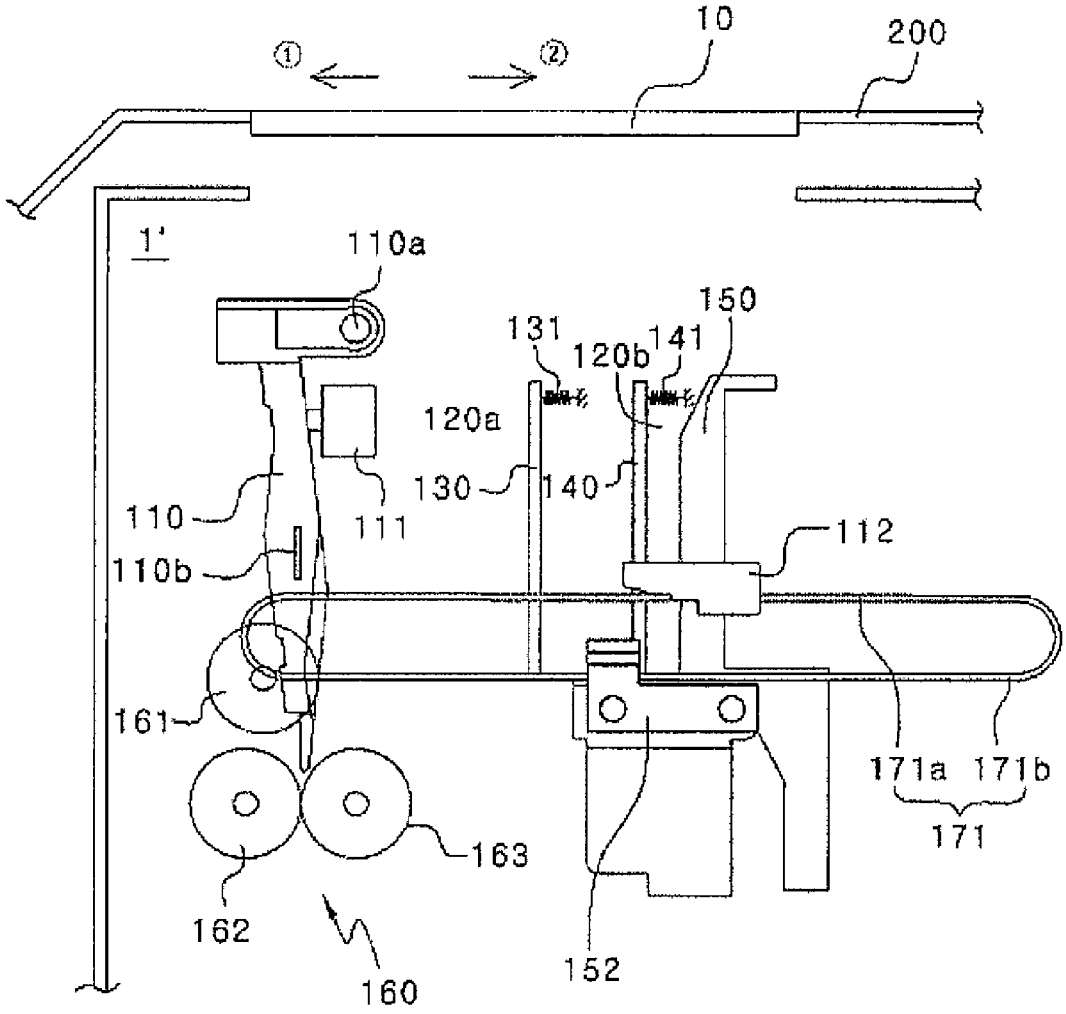

[Fig.4]
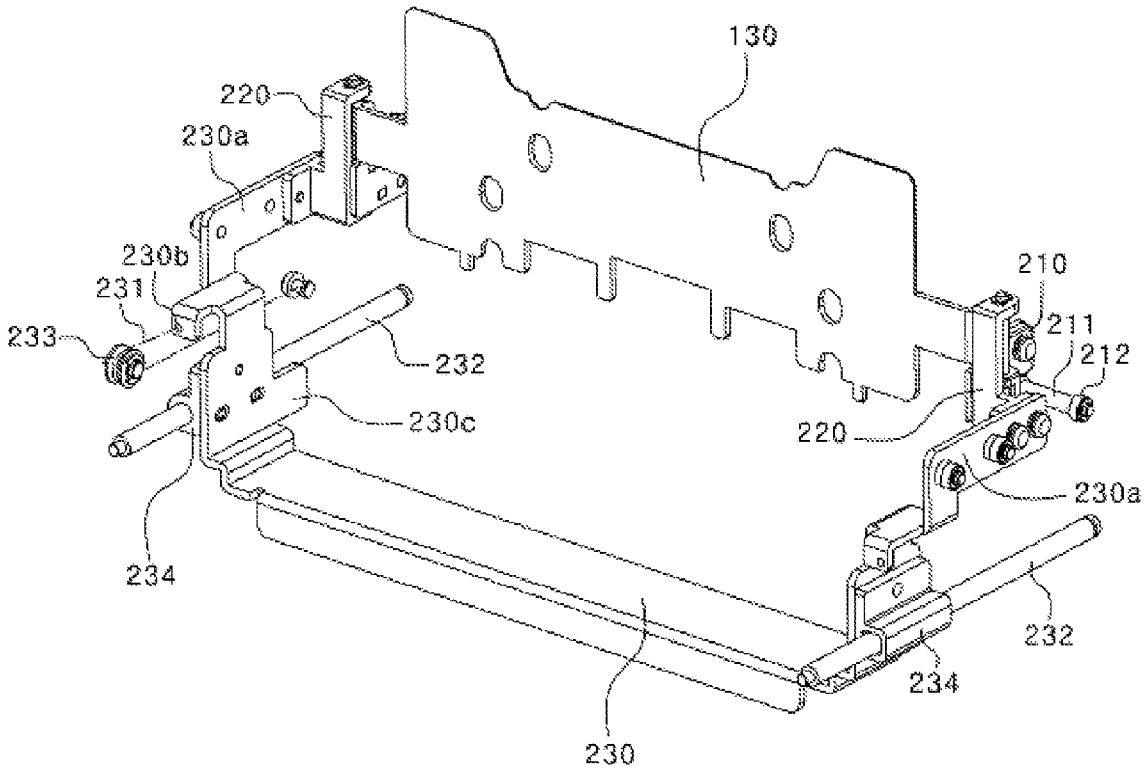

[Fig.5]
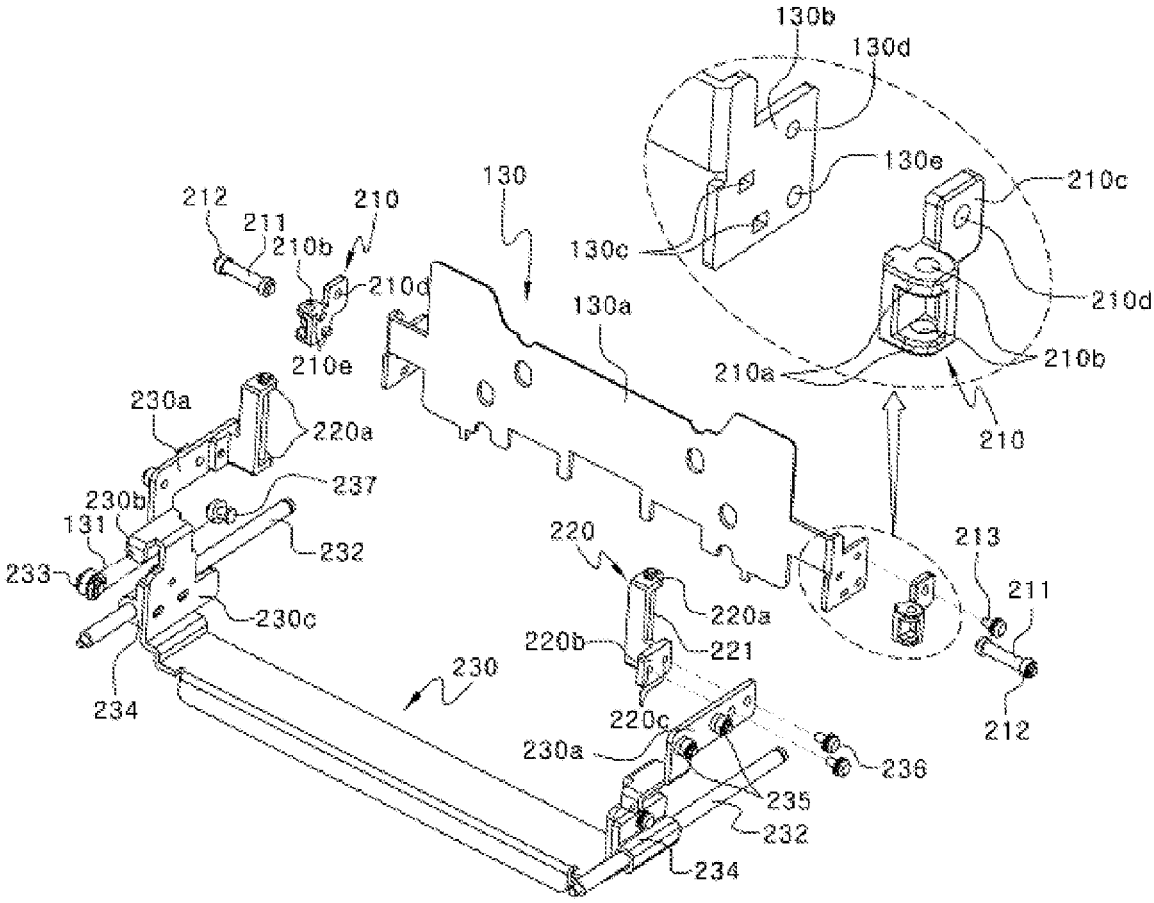

[Fig.6]
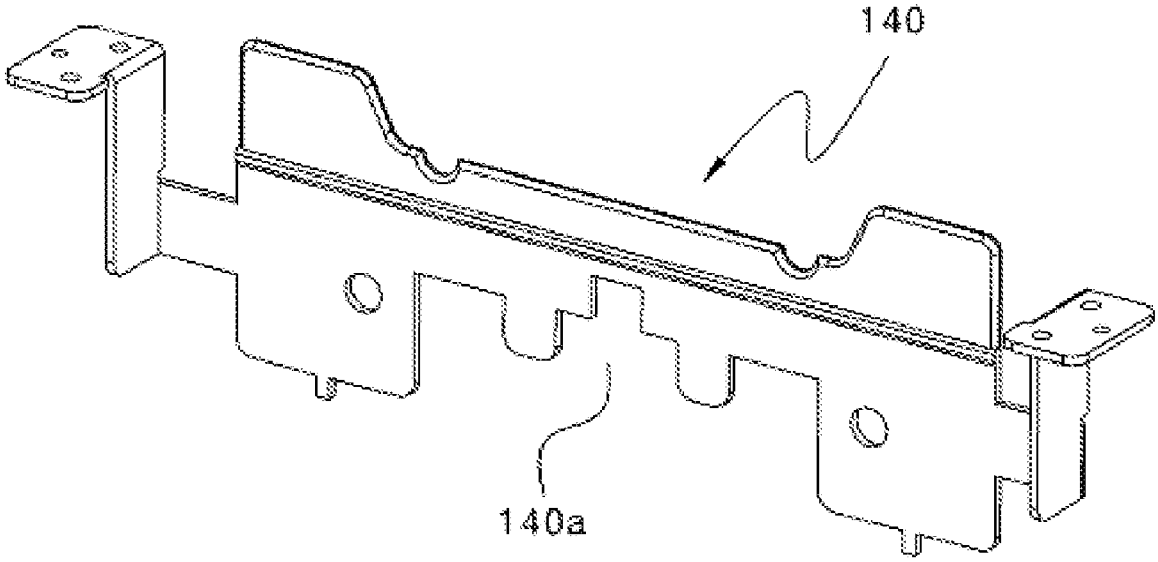

[Fig.7a]
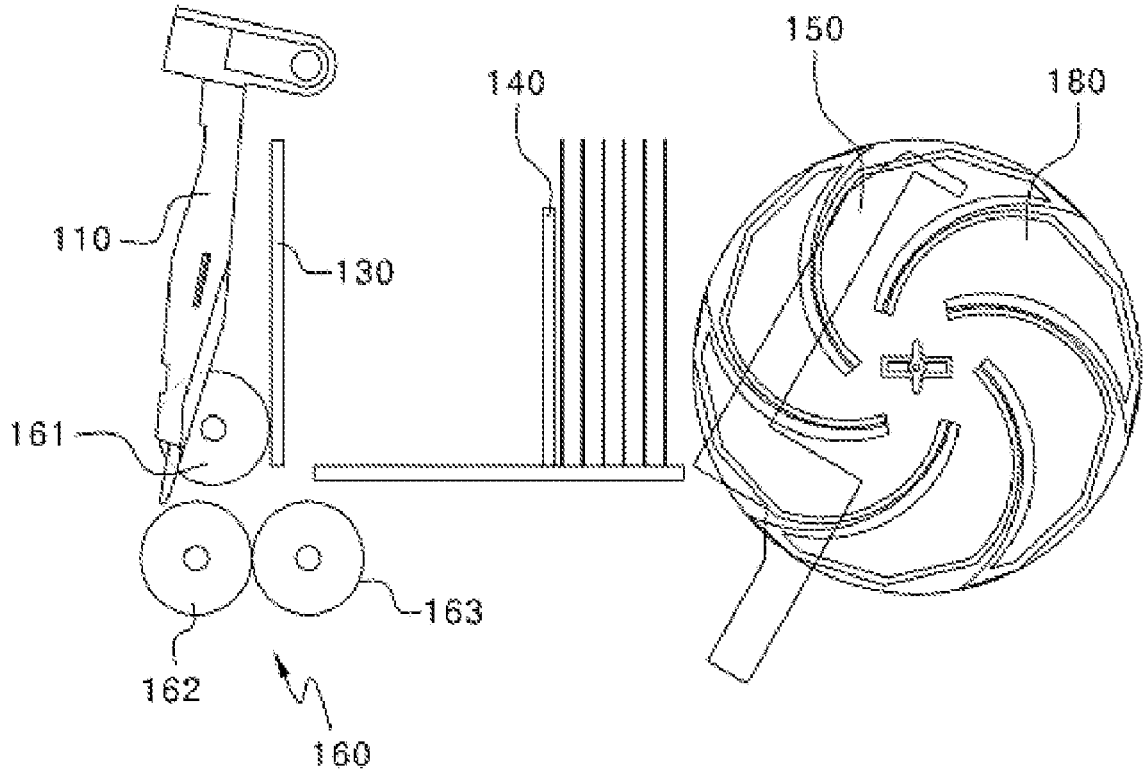

[Fig.7b]
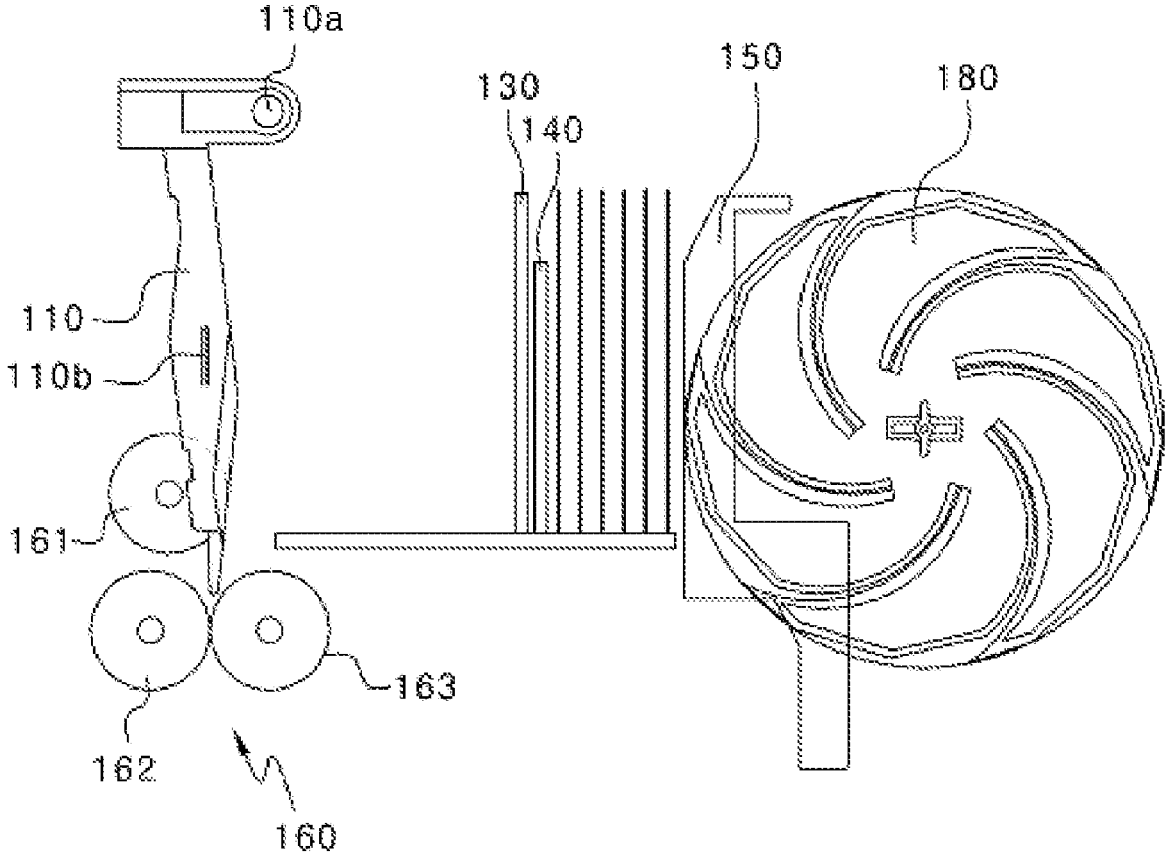

[Fig.7c]
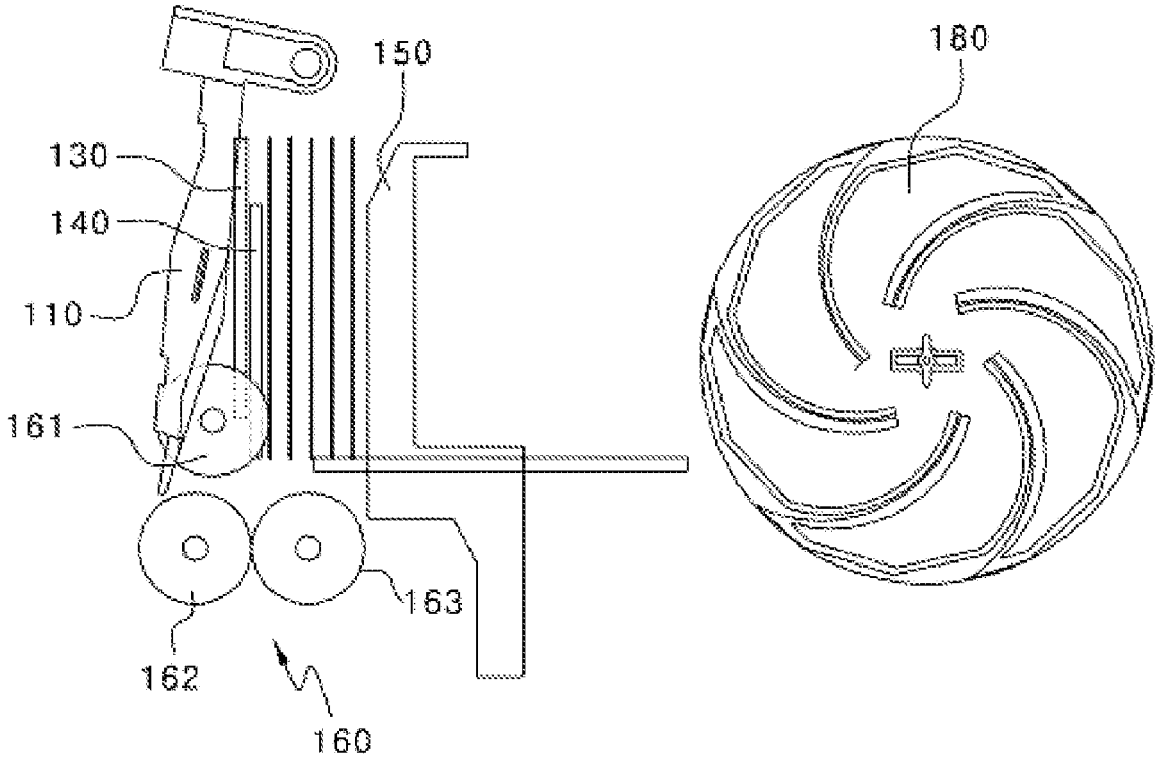

[Fig.8]
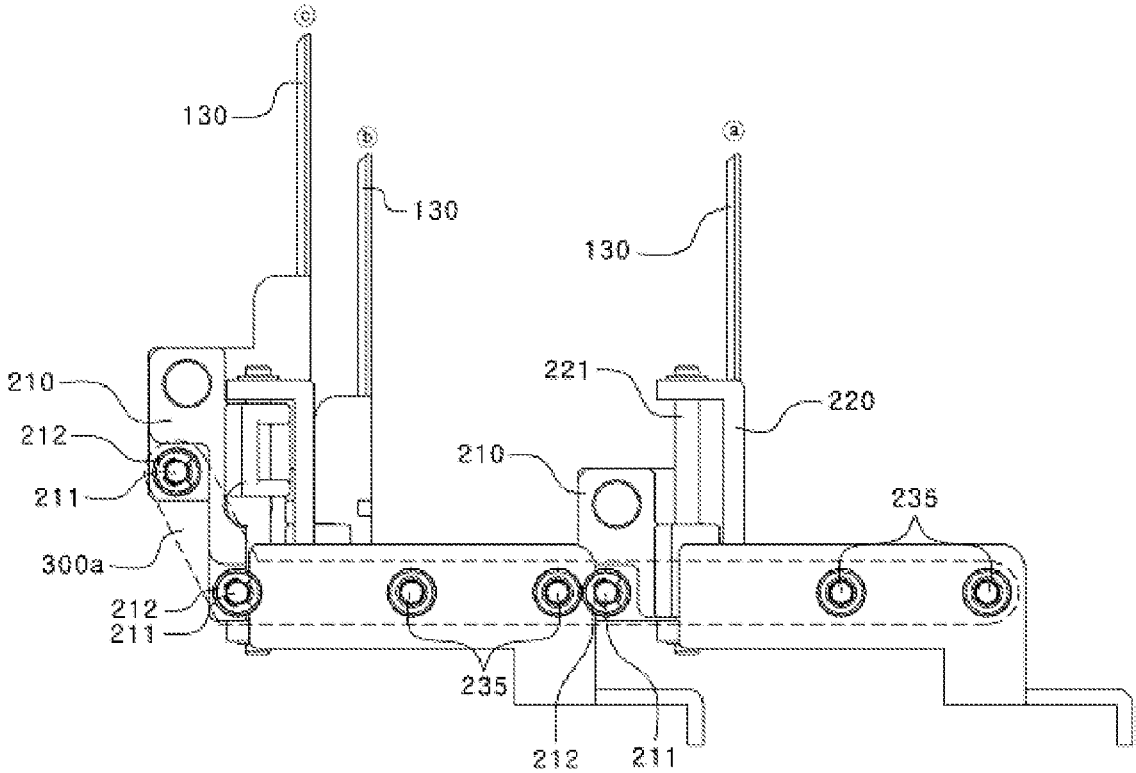

BILL RECYCLING MACHINE

TECHNICAL FIELD

The present invention relates to a bill recycling machine, and more particularly to a bill recycling machine having a push plate which can exert required separation pressure on bills when the bills are inserted and avoid an interference with a pickup roller when untaken bills are collected again.

BACKGROUND ART

In general, an Automated Teller Machine (ATM) includes an input part by which a customer inputs information, a screen part displaying financial service menus and a transaction situation, and a bill recycling machine through which the customer can insert or receive bills in order to perform depositing/withdrawing transaction, and the customer can deposit/withdraw bills through the bill recycling machine.

FIG. 1 is a side perspective view illustrating a typical bill recycling machine, and FIG. 2 is a side perspective view illustrating an input/output part of the bill recycling machine, through which bills are inserted/outputted by the customer.

With reference FIG. 1, an ATM through which bills are deposited/withdrawn includes: a controller performing a control operation so that overall operation of the bill recycling machine including an operation of depositing/withdrawing bills are controlled; a depositing/withdrawing part 1 through which the customer inserts or receives bills in order to deposit/withdraw the bills; a returning path 2 along which bills deposited/withdrawn through the depositing/withdrawing part 1 are transferred; an identifying part 3 installed at the returning path 2 so as to identify if any error of the bills exists; a temporary storage part 4 in which the inserted bills after passing through the identifying part 3 are temporarily stacked; a plurality of recycling boxes 5 performing a recycling function so that bills inserted from the customer are stacked and the stacked bills are output; and a reject box 6 receiving bills which have been identified as erroneous bills at the identifying part 3.

As shown in FIG. 2, the depositing/withdrawing part 1 includes: a bill receiving space 20 formed at the lower part of a shutter 10 which is opened/closed so as to allow the customer to insert bills in depositing the bills and to receive bills in withdrawing the bills; a stack plate 30 divides the bill receiving space 20 into the first bill receiving space 20*a* and the second bill receiving space 20*b*; a transfer plate 40 is positioned so as to make contact with the stack plate 30 in an initialization state as a standby stage for depositing/withdrawing bills; an elevation plate 50 installed at the lower part of the first bill receiving space 20*a* so as to be elevated; a push plate 60 pushing bills toward a separating part 70 in a state where bills are stacked on the elevation plate 50 and are moved downward; the separating part 70 separating the bills pushed by the push plate 60 from each other; and a front plate 80 forming a wall surface of a front side of the bill receiving space 20 formed at the lower part of the shutter 10.

The separating part 70 includes a pickup roller 71 allowing bills to be separated from each other, a feed roller 72 feeing each bill separated by the pickup roller 71, and a guide roller 73 making contact with the feed roller 72 so as to prevent the bills from being separated from each other.

DISCLOSURE

Technical Problem

In a bill cycle machine having such a structure, when a customer inserts bills into a first bill receiving space 20*a* so as to deposit the bills, a separating part 70 has to be positioned at the lower part of the first bill receiving space 20*a* so as to move an elevation plate 50' downward and then to separate bills. Therefore, the bill cycle machine has to include a separation driving device which can elevate the elevation plate 50, thereby having a complicated structure.

Also, a push plate 60 and the separating part 70 are positioned at the lower part of the bill receiving space 20, thereby increasing volume of the machine.

So as to resolve the problem, in a case where the push plate 60 is positioned at the same level as the stack plate 30, the push plate 60 can apply separation pressure required for separating bills, and so as to make untaken bills, which the customer does not receive, among bills processed to be withdrawn, be deposited into the reject box, it is required to reset the position relation between the stack plate 30, the push plate 60, and a pickup roller 71.

The present invention has been made in view of the above-mentioned problems, and the present invention provides a bill recycle machine including a push plate for pressing bills, which can exert separation pressure required for separating bills and also have an elevation-structure allowing upward and downward movement so as to prevent the push plate from being interfered with by a pickup roller when untaken bills are collected again.

Technical Solution

In accordance with an aspect of the present invention, there is provided a bill recycle machine including: a front plate forming a wall surface of a front side of a bill receiving space formed at a lower part of a shutter, the front plate rotating about a hinge shaft of an upper part of the front plate so that a pickup roller appears and disappears; a push plate which forms a first bill receiving space between the push plate and the front plate, can be moved along a horizontal guide member by driving of a motor in front and rear directions, and is elevated upward and downward along a vertical guide member integrally assembled with a supporting bracket sliding along the vertical guide member; a stack plate installed at an opposite side of the first bill receiving space, based on the push plate, so as to support bills stacked by a stack wheel; and a transfer plate forming a second bill receiving space between the transfer plate and the stack plate.

Wherein, a push plate assembling member is assembled with a side plate part of the push plate and has vertical guide member inserting holes extending through the push plate assembling member in upper and lower directions, and the vertical guide member is inserted into the vertical guide member inserting holes.

Also, a side surface guide member, which has a bar-shape and includes a bearing assembled with one end of the side surface guide member, is assembled with both ends of the push plate, and the bearing is inserted into a guide groove of a frame formed along a path where the push plate is horizontally moved forward and backward and is also elevated up and down.

Meanwhile, the path for elevation of the guide groove is slanted frontward.

Wherein, the bill recycle machine further includes upper and lower bent parts bent while making a 'U'-shape, with which both ends of the vertical guide member are assembled, and a connecting bracket including a side surface assembling part of a 'T'-shape extending from a body between the upper and lower bent parts toward a side direction, wherein the side surface assembling part of the connecting bracket is assembled with each upper part of both ends of the supporting bracket.

Advantageous Effects

As described above, in the bill recycle machine according to the present invention, a push plate is installed at the same level as a stack plate so that the bill recycle machine has a simple structure and small volume thereof, and also the push plate can apply separation pressure required for separating bills and prevent the push plate from being interfered with by the pickup roller when untaken bills are collected again.

BRIEF DESCRIPTION OF THE DRAWINGS

The foregoing and other objects, features and advantages of the present invention will become more apparent from the following detailed description when taken in conjunction with the accompanying drawings in which:

FIG. 1 is a schematic side perspective view illustrating a typical bill recycle machine;

FIG. 2 is a schematic side perspective view illustrating a depositing/withdrawing part of the bill recycle machine as shown in FIG. 1, in which bills are inserted and received by a customer;

FIG. 3 is a schematic side perspective view illustrating a bill recycle machine according to an embodiment of the present invention;

FIG. 4 is a perspective view illustrating the assembling structure of a push plate according to an embodiment of the present invention;

FIG. 5 is an exploded perspective view illustrating an assembling structure of the push plate as shown in FIG. 4; and FIG. 6 is a perspective view illustrating a stack plate included in the bill recycle machine according to the present invention.

FIGS. 7*a*, 7*b* and 7*c* are views illustrating the procedure of collecting untaken bills again when bills are withdrawn through the bill recycle machine according to the present invention; and FIG. 8 is a view illustrating the operation of a push plate according to the present invention.

BEST MODE

Mode for Invention

Hereinafter, the construction and function of an exemplary embodiment of the present invention will be described with reference to the accompanying drawings. In the following description, the same elements will be designated by the same reference numerals although they are shown in different drawings.

FIG. 3 is a schematic side perspective view illustrating a bill recycle machine according to an embodiment of the present invention, FIG. 4 is a perspective view illustrating the assembling structure of a push plate according to an embodiment of the present invention, FIG. 5 is an exploded perspective view illustrating an assembling structure of the push plate as shown in FIG. 4, and FIG. 6 is a perspective view illustrating a stack plate included in the bill recycle machine according to the present invention. Hereinafter, as shown in FIG. 3, the direction of an error ① refers to "a front direction," and the direction of an error ② refers to "a rear direction."

Hereinafter, a bill recycle machine according to the present invention will be described with reference to FIG. 3.

The present invention is a bill recycle machine through which a customer inserts bills so as to deposit the bills or receives bills which have been withdrawn, and a shutter 10 is installed at the upper part of the bill recycle machine. Although the shutter 10 can be installed at the upper part of the bill recycle machine as shown in FIG. 1, the shutter 10 is also installed in an outer case 200 of an ATM according to the present embodiment.

A separating part 160 is included at a lower depositing/withdrawing part 1' of the shutter 10 so as to separate bills from each other. The separating part 160 includes a pickup roller 161 allowing bills to be separated from each other, a feed roller 162 feeding each bill separated by the pickup roller 161, and a guide roller 163 making contact with the feed roller 162 so as to prevent bills from being stuck together. The pickup roller 161 of the separating part 160 is installed at a level similar to the level of the lower part of inserted bills in a vertical direction so as to make contact with the lower part of the inserted bills when the customer inserts the bills so as to deposit them. Also, a separation pressure sensor (not shown) is installed at a front side of the pickup roller 161 so as to sense the fact that the pickup roller 161 is pushed frontward to a position allowing the pickup roller 161 to obtain frictional force required for separating bills.

A front plate 110 rotating about a hinge shaft 110*a* of the upper part thereof is installed at an upper side of the separating part 160. When bills are inserted, the front plate 110 rotates about the hinge shaft 110*a* in a counter-clockwise direction so as to prevent alien substance from flowing into the separating part 160 so that the pickup roller 161 can be prevented from being exposed. When bills are separated, the front plate 110 rotates about the hinge shaft 110*a* in a clockwise direction so that the pickup roller 161 is exposed so as to make contact with bills stacked in the first bill receiving space 120*a*.

A push plate 130 is installed so as to form the first bill receiving space 120*a* between the push plate 130 and the front plate 110 and to push the bills stacked in the first bill receiving space 120*a* toward the pickup roller 161 so as to apply separation pressure.

The push plate 130 is moved frontward by driving force of a push plate driving motor (not shown) and is moved backward by restoring force of a spring 131 installed so as to pull the push plate 130 in a rear direction. Also, the push plate 130 has to have a shape with a sufficient contact area so as to push bills under proper separation pressure toward the pickup roller 161 when bills are inserted.

A stack plate 140 is installed in the rear direction of the push plate 130 so as to support bills stacked through a stack wheel 180. The stack plate 140 has a spring 141 pulling the stack plate 140 in the rear direction connected therewith. The stack plate 140 is not driven by a separate motor, but is moved forward along with forward movement of a transfer plate 150. The stack plate 140 is moved backward by the restoring force of the spring 141 along with the backward movement of the transfer plate 150. At this state, a limit position (herein, refers to a 'stack position'), where the stack plate 140 is moved backward by restoring force of the spring 141, is restricted by a stopper (not shown).

Also, as shown in FIG. 6, the stack plate 140 has a recessed central part, with which bills can make contact, so as to allow the bills stacked between the stack plate 140 and the transfer plate 150 to make direct contact with the pickup roller 161 according to the forward movement of the transfer plate 150 when untaken bills are collected again.

The second bill receiving space 120*b* is formed in the rear direction of the stack plate 140, and the transfer plate 150 is installed in the rear direction of the stack plate 140 so that the second bill receiving space 120*b* is formed between the transfer plate 150 and the stack plate 140.

A belt 171 is installed at both sides of the transfer plate 150 so as to move the transfer plate 150 forward and backward. While the belt 171 is rotated by driving of a transfer plate driving motor (not shown), the belt 171 integrally moves a belt coupling member 152 assembled with a lower line 171*b* of the belt 171 and a transfer plate 150 assembled with the belt coupling member 152 in the front and rear directions. A front plate pressure member 112 is installed at an upper line 171*a* of the belt 171. The front plate pressure member 112 makes contact with a side plate 110*b* protruding in a side direction of the front plate 110 so as to rotate the front plate 110 about a hinge shaft 110*a* in a clockwise direction. Therefore, the pickup roller 161 is exposed toward a rear direction of the front plate 110.

A numeric reference 111, which is not described, refers to a solenoid so as to maintain the locked state of the front plate 110 when the front plate 110 is rotated in a counter-clockwise direction when bills are inserted.

Hereinafter, with reference to FIGS. 4 and 5, the assembling structure of the push plate included at the bill recycle machine according to the present invention will be described.

According to the present invention, the push plate 130 have to move in the front and rear directions by driving of the push plate driving motor, and also has to have a structure allowing the upward elevating movement of the push plate 130 so as to prevent the push plate 30 from being interfered with by the pickup roller 161 when untaken bills are collected again.

Particularly, so as to perform movement in the front and rear directions, the push plate 130 is installed in such a manner that a supporting bracket 230 supporting the push plate 130 slides along a horizontal guide member 232, and the push plate 130 slides along a vertical guide member 221 integrally assembled with the supporting bracket 230 so as to be elevated.

Hereinafter, an embodiment of the structure where the push plate 130 and the vertical guide member 221 are assembled with each other with reference to FIGS. 4 and 5 will be described.

The push plate 130 has a side plate part 130*b* formed at both ends of a bill contact part 130*a* of the center thereof while being bent at 90 degrees. A protuberance part 210*e* formed at the rear surface of the push plate assembling member 210 is inserted into an inserting hole 130*c* of the side plate part 130*b*. A fastening member 213 is fastened in a fastening hole 130*d* through a fastening hole 210*d* formed at a assembling body 210*c* of a push plate assembling member 210, so that a push plate assembling member 210 and a push plate 130 are assembled with each other.

Vertical guide member inserting holes 210*b* extending through the inserting body 210*a* in upper and lower directions are formed at inserting bodies 210*a* extending from the assembling body 210*c* of the push plate assembling member 210 toward a side direction thereof, and the vertical guide member 221 is inserted into the vertical guide member inserting hole 210*b*.

Also, a coupling hole 130*e*, with which one end of a side guide member 211 is assembled, is formed at the side plate part 130*b* of the push plate 130, and a bearing 212 is coupled with the other end of the side guide member 211. The bearing 212 is inserted into the guide groove 300*a* formed at a frame (not shown) installed at a side thereof, and a guide groove 300*a* extends upward from end part of a groove having a predetermined length in a horizontal direction while being slanted at a predetermined angle in an upper direction.

Therefore, in a state where the push plate 130 and the push plate assembling member 210 are integrally assembled with each other, the bearing 212 of the side guide member 211 horizontally moves and also moves in upper and lower directions along the guide groove 300*a* while being slanted.

Hereinafter, an embodiment of the structure where the vertical guide member 221 and the supporting bracket 230 are assembled with each other will be described with reference to FIGS. 4 and 5.

The vertical guide member 221 of a bar-shape is assembled with a connecting bracket 220 assembled with an upper part 230*a* formed at both ends of the supporting bracket 230. The connecting bracket 220 includes an upper and lower bent parts 220*a* having a 'U'-shape, with which both ends of the vertical guide member 221 are assembled, and a side surface assembling part 220*b* of a 'T'-shape extending from the body between the upper and lower bent parts 220*a* toward a side direction. The side surface assembling part 220*b* has a fastening hole 220*c* so as to be assembled with the upper part 230*a* of the supporting bracket 230 by a fastening member 236.

A bearing 235 is assembled with an outer surface of the upper part 230*a* of the supporting bracket 230, and the bearing 235 is inserted into the guide groove 300*a* of the frame so that the bearing 235 can smoothly move when the push plate 130 moves in the front and rear directions.

The supporting bracket 230 is pulled by the spring 131 in a rear direction. One end of the spring 131 is connected with a spring fixing part 237 fixed in the frame, and the other end thereof passes through a groove of the spring guide member 233 so as to be connected with a spring connecting hole 230*b* of the supporting bracket 230. Therefore, after the push plate 130 is moved in the front direction by the push plate driving motor, the push plate 130 can be moved in the rear direction by restoring force of the spring 131.

Meanwhile, a slide member 234 is assembled with an outer side of a side surface part 230*c* of the supporting bracket 230. The horizontal guide member 232 is inserted into the slide member 234 so that the supporting bracket 230 and the push plate 130 connected with the supporting bracket 230 slide along the horizontal guide member 232 in front and rear directions.

Hereinafter, the operation of retrieving untaken bills according to the present invention having a structure as described above will be described.

FIGS. 7*a*, 7*b* and 7*c* are views illustrating the procedure of retrieving untaken bills when bills are withdrawn trough the bill recycle machine according to the present invention, and FIG. 8 is a view illustrating the operation of a push plate according to the present invention.

Firstly, with reference to FIG. 7*a*, bills of a recycle box 5 are stacked on the second bill receiving space 120*b* according to the request of the customer. At this state, so as to allow bills to enter into the second bill receiving space 120*b* through the stack wheel 180, the transfer plate 150 is shunted at a 'bill withdrawal standby position' (a position at which the transfer plate 150 is shunted so as to allow bills to be stacked between the stack plate and the stack wheel and a state where the transfer plate falls down in the rear direction as shown in FIG. 7*a*), and a stack plate 140 is positioned at a 'stack position' so as to support bills entering into the second bill receiving space 120*b*. Herein, the 'stack position' is a position where the stack plate 140 is spaced a required distance from the stack wheel 180 so as to allow bills to be stacked, and refers to the furthest rear position among positions at which the stack plate 140 moves to be located.

In this case, according to the increase of the number of bills stacked in the second bill receiving space 120*b*, the stack plate 140 moves forward while overcoming force of the spring 141. Herein, if the push plate 130 is positioned so as to make contact with the stack plate 140, there is a difficulty in that bills stacked in the second bill receiving space 120*b* have to be stacked while overcoming force of two springs 131 and 141. Therefore, when bills are stacked in the second bill receiving space 120*b*, it is preferable that the push plate 130 is spaced a predetermined distance from the stack plate 140 so as not to make contact with the stack plate 140 according the increase of the number of bills.

In this case, since there is a need to detect the position of the push plate 130 so as to perform a following control demand, the push plate 130 pushes a pickup roller 161 and then the separation pressure sensor senses it so that the push plate 130 is moved forward to a position determined as 'a separation pressure position.' Particularly, as shown in FIG. 8, when the push plate 130 is positioned at the position ⓑ, the push plate is positioned at the 'separation pressure position,' and in this case, the side guide member 211 and the bearing 212 are positioned at a boundary between a horizontal groove and a slanted groove of the guide groove 300*a*.

Then, with reference to FIG. 7*b*, the shunted transfer plate 150 moves from the 'withdrawal standby position' to 'deposition standby position' (an initialization position of the transfer plate 150 when bills are inserted, and a state where the transfer plate 150 is erected as shown in FIG. 7*b*), and the push plate 130 spaced a predetermined distance from the stack plate 140 moves to the 'deposition standby position' (a initialization position of the push plate 130 when bills are inserted, and the position ⓐ as shown in FIG. 8) by restoring force of the spring 131. But, the position of the push plate 130 is varied according the number of bills stacked in the second bill receiving space 120*b*.

After that, the customer transfers the transfer plate 150 forward to a position allowing the customer to receive bills stacked in the second bill receiving space 120*b*, and then the customer receives the bills. Accordingly, the procedure of withdrawing bills is finished.

When the customer does not receive bills stacked in the second bill receiving space 120*b*, as shown in FIG. 7*c*, the push plate 130 is moved forward and then is elevated to a 'retrieval position' (a case where the push plate 130 is located at the position ⓒ as shown FIG. 8). Particularly, the push plate 130 and the push plate assembling member 210 are guided along the guide groove 300*a* in a slanted upper direction by the side guide member 211 and the bearing 212, and is simultaneously guided by the vertical guide member 221 in an upper direction so as to be positioned at the 'retrieval position.' Therefore, the push plate 130 is lifted up to an upper side of the pickup roller 161 so as not to be an obstacle when bills are separated.

Also, the central part of the stack plate 140*a* of the stack plate 140, which can makes contact with bills, has a depressed shape so as to allow the pickup roller 161 to make direct contact with bills. Therefore, when the transfer plate 150 is transferred forward, bills makes contact with the pickup roller 161, and when the separation pressure sensor senses it, the bills are separated by the pickup roller so that the retrieving procedure is performed. Herein, a separated bill is transferred to the reject box 6 so as to be separately kept.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A bill recycle machine comprising:

a front plate forming a wall surface of a front side of a first bill receiving space formed at a lower part of a shutter, the front plate rotating about a hinge shaft of an upper part of the front plate so that a pickup roller appears and disappears;

a push plate, which forms the first bill receiving space between the push plate and the front plate, can be moved along a horizontal guide member in front and rear directions, and is elevated up and down along a vertical guide member integrally assembled with a supporting bracket sliding along the vertical guide member, the supporting bracket including a first end and a second end;

a stack plate installed at an opposite side of the first bill receiving space, based on the push plate, so as to support bills stacked by a stack wheel;

a transfer plate forming a second bill receiving space between the transfer plate and the stack plate;

upper and lower bent parts bent while making a 'U'-shape, with which both ends of the vertical guide member are assemble; and a connecting bracket including side surface assembling parts of a 'T'-shape extending from a body between the upper and lower bent parts toward a side direction, wherein one of the side surface assembling parts of the connecting bracket is assembled with an upper part of the first end of the supporting bracket and the other of the side surface assembling parts of the connecting bracket is assembled with an upper part of the second end of the supporting bracket.

2. The bill recycle machine as claimed in claim 1, wherein a push plate assembling member is assembled with a side plate part of the push plate and has vertical guide member inserting holes extending through the push plate assembling member in upper and lower directions, and the vertical guide member is inserted into the vertical guide member inserting holes.

3. The bill recycle machine as claimed in claim 1, wherein a side surface guide member, which has a bar-shape and includes a bearing assembled with one end of the side surface guide member, is assembled with both ends of the push plate, and the bearing is inserted into a guide groove of a frame formed along a path where the push plate is horizontally moved forward and backward and is also elevated up and down.

4. The bill recycle machine as claimed in claim 3, wherein the path for elevation of the guide groove is slanted frontward.

* * * * *